US005470174A

United States Patent [19]

Hu et al.

[11] Patent Number: 5,470,174

[45] Date of Patent: Nov. 28, 1995

[54] EXPANSION JOINT ASSEMBLY HAVING LOAD TRANSFER CAPACITY

[75] Inventors: Kuo-Kuang Hu; Philip G. Kirmser; Stuart E. Swartz; Mustaque Hossain, all of Manhattan, Kans.

[73] Assignee: Kansas State University Research Foundation, Manhattan, Kans.

[21] Appl. No.: 329,306

[22] Filed: Oct. 26, 1994

Related U.S. Application Data

[63] Continuation of Ser. No. 13,688, Feb. 4, 1993, Pat. No. 5,366,319.

[51] Int. Cl.[6] ..... E01C 5/08

[52] U.S. Cl. ..... 404/52; 404/61; 404/70; 52/396.02

[58] Field of Search ..... 404/2, 50, 51, 404/52, 53, 54, 55, 56, 62, 61, 63, 66, 68, 70; 52/396.02, 396, 583, 587; 285/133.1, 53; 138/118.1, 145

[56] References Cited

U.S. PATENT DOCUMENTS 2,164,590 7/1939 Oates .

FOREIGN PATENT DOCUMENTS 252985 3/1967 Austria .

*Primary Examiner*—Ramon S. Britts
*Assistant Examiner*—Pamela A. O'Connor
*Attorney, Agent, or Firm*—Hovey, Williams, Timmons & Collins

[57] ABSTRACT

A prefabricated roadway expansion joint/load transfer assembly (10) is provided which accommodates normal expansion and contraction between adjacent slabs (90*a*, 90*b*) while transferring vertical shear loads and minimizing stress cracking of the surrounding concrete (90). The assembly (10) includes a plurality of X-configuration bar units (12) including crossed, unconnected metallic bars (20, 22) whose ends (24, 30, 28, 26) are embedded within the adjacent slabs (90*a*, 90*b*). The bar ends (24, 30, 28, 26) are coupled within the corresponding slabs (90*a*, 90*b*) through use of respective U-shaped coupling assemblies (14) each having spaced legs (38, 40) and a bight (42), and vertical tie rods (44). The individual bar units (12) are joined by laterally extending connecting rods (56–70). A central spacer (18) is supported by the bar units (12) and supplementary spring supports (76) and extends the full width of the assembly (10). In use, the cage-like assembly (10) is placed across a prepared road bed (88), and concrete (90) is poured over the assembly (10). The spacer (18) creates the necessary joint without the need for subsequent sawing of the concrete (90).

4 Claims, 2 Drawing Sheets

14a
90
92
58
38
10a
24
76
32
18a
93
46
28
64
38c
66
62
40a
88
14
90a
12
48
20
44
22
50
60
30
18
72
82
86
80
74
78
5
26
54
40
70
42
90b
30a

EXPANSION JOINT ASSEMBLY HAVING LOAD TRANSFER CAPACITY

This application is a continuation of application Ser. No. 08/013,688, filed Feb. 4, 1993 U.S. Pat. No. 5,366,319.

BACKGROUND OF THE INVENTION

1. Field of the Invention

The present invention is broadly concerned with an improved, preferably prefabricated expansion joint assembly adapted for use in joining concrete roadway slabs in order to properly transfer vertical shearing forces while minimizing stress cracking of the slabs commonly experienced using conventional dowel-type expansion joints. More particularly, the invention pertains to an expansion joint assembly including pairs of elongated, obliquely oriented load transfer bars each configured to present a general X-configuration and bridging an expansion joint between concrete slabs, with the ends of the respective load transfer bars being embedded within the slabs; the oblique bars are preferably unconnected in the joint region, and structure may be provided for coupling the embedded bar ends within each slab to each other in order to safely accommodate expansion and contraction of the slabs while also insuring proper load transfer therebetween.

2. Description of the Prior Art

In the construction of concrete roadways, it is common practice to install expansion joint assemblies at spaced locations, so that the completed roadway can properly expand and contract under varying temperature and environmental conditions. Typically, such expansion joint assemblies make use of a plurality of laterally spaced apart dowel units including a tubular barrel embedded within one concrete slab, with a dowel aligned with the barrel and embedded in the adjacent slab. In this fashion, as the adjacent slabs expand and contract, the dowels guide resultant slab movement. An exemplary dowel-type expansion joint assembly is illustrated in U.S. Pat. No. 2,500,262.

While the use of such prior expansion joints is well established, a number of very serious problems remain. In the first place, the installation of these dowel assemblies is relatively expensive and labor-intensive. In particular, it is first necessary to set the respective dowel units in laterally spaced relationship across a roadway foundation at desired joint locations, followed by pouring of concrete over the units. After the concrete is set, laterally extending slots must be cut in the concrete at the regions of dowel assemblies, so as to provide the necessary joints between respective concrete slabs. In such a procedure, it is very easy to misalign one or more of the dowel units, and moreover the subsequent cutting of expansion slots must be carefully done, lest the slots be improperly made relative to the positions of the dowel units.

In addition, experience has proved that prior dowel-type expansion joint assemblies are prone to create stress cracking in the concrete slabs, particularly at the regions directly below the dowel rod and barrel. This results from the vertical shearing loads experienced by the concrete slabs, which are only imperfectly transmitted by the dowel assemblies; as a consequence, a significant early failure rate has been encountered with these prior expansion joints.

U.S. Pat. No. 2,509,663 describes a load transfer device made up of obliquely oriented embedded rods which are twisted together at the midpoints thereof to define a joint. This design requires that the rods concurrently carry tension and compression loads, which can induce failure in the concrete roadway.

There is accordingly a real and unsatisfied need in the art for an improved expansion joint assembly which can be largely prefabricated to reduce costs, while at the same time being readily installable in the field and reducing or eliminating large shearing stresses in the surrounding concrete slabs, thereby minimizing load-induced roadway deterioration.

SUMMARY OF THE INVENTION

The present invention overcomes the problems outlined above, and provides a greatly improved expansion joint assembly for a pair of adjacent concrete slabs having an elongated expansion joint or slot therebetween. Broadly speaking, the expansion joint assembly of the invention includes a number of spaced bar units each having a pair of elongated load transfer bars presenting a pair of opposed ends, with the bars being oriented obliquely relative to the expansion joint to cooperatively present a generally X-configuration of bars bridging the joint. The load transfer bars are unconnected throughout the obliquely extending lengths thereof, so that the bars can separately carry tensile and compressive loads.

Preferably, the opposed ends of each bar are embedded in respective slabs, and means is provided for coupling the embedded bar ends within each slab to each other at regions remote from the expansion joint, so that vertical shearing forces are properly transmitted between the concrete slabs. Further, the bars are advantageously sheathed in a resilient sleeve to reduce stresses and to decouple stresses between the bars and concrete slabs. The preferred resilient sleeves include a plurality of circumferentially spaced, elongated, inner ribs in engagement with the associated load transfer bar. Such sheathing serves to reduce local stresses which could cause progressive failure of the surrounding concrete.

As indicated, the embedded ends of the load transfer bars are preferably coupled within each slab. This is advantageously accomplished by means of arcuate, generally U-shaped rod segments embedded within each slab adjacent corresponding bar units and presenting a pair of spaced legs and a bight. The legs are operatively connected (e.g, by welding or integrally forming) to the load transfer rod ends within each slab. In addition, in this embodiment, a vertically extending tie rod is employed to interconnect the legs within each slab, with the tie rods being located adjacent the load transfer rod ends.

In another embodiment, the coupling means comprises s pair of elongated, generally horizontally extending leg members adjacent the opposite ends of each bar unit and embedded within the slabs. These leg members are respectively operatively connected to corresponding load transfer rod ends within the slabs, again by welding or equivalent means. A tie bar extends between and interconnects these leg members at a point remote from the expansion joint. In particularly preferred forms, a pair of spaced apart tie rod members are provided, both of which are vertically oriented and with one tie rod closely adjacent the ends of the load transfer bars, while the other tie rod is spaced therefrom.

The preferred joint assemblies of the invention also include an upright, plate-type spacer element which is positioned prior to pouring of concrete over the expansion joint assembly, in order to eliminate the need for subsequent saw cutting of the concrete. The spacer serves as a means of removing moisture, and is preferably in the form of a board made of vertical fibers. The spacing between the vertical fibers defines capillary tubes so that moisture is effectively removed and does not accumulate at the expansion joint. In another embodiment, a specially designed spacer is employed which presents a plurality of elongated, vertically offset, alternating grooves along the opposed faces thereof. This spacer also effectively removes water trapped inside or under the expansion joint.

In particularly preferred forms, the expansion assembly of the invention is provided as a prefabricated cage-like assembly which can be factory-made and installed in the field. Such a structure includes plural X-configuration load transfer bar units with laterally projecting leg members and endmost coupling devices previously described. Means is also provided for mounting the individual load transfer bar units in laterally spaced apart, generally parallel relationship, including a plurality of laterally extending connecting rods secured to the individual leg members. These lateral connecting rods serve to distribute bearing stresses between the oblique load transfer bars and surrounding concrete.

The spacer plate used in the prefabricated assembly is in the form of a laterally extending, upright, slotted spacer which is positioned at the crossing points of the respective X-configuration load transfer bar units. The spacer plate is held in place by means of spring-like wire mesh secured to the load transfer bar units.

A prefabricated assembly as described can be used by simply placing it across a prepared roadbed. At this point, concrete is poured in the usual fashion such that the expansion joint assembly is fully embedded within the concrete, with the uppermost margin of the spacer plate at the upper level of the poured concrete. As can be appreciated, provision of the upright spacer plate forms the desired expansion slot for the roadway, all without the necessity of subsequent cutting of the poured concrete. At the same time, the embedded assembly both accommodates usual expansion and contraction, but also effectively transfers loads.

DETAILED DESCRIPTION OF THE PREFERRED EMBODIMENTS

Figures 1, 4, 5:
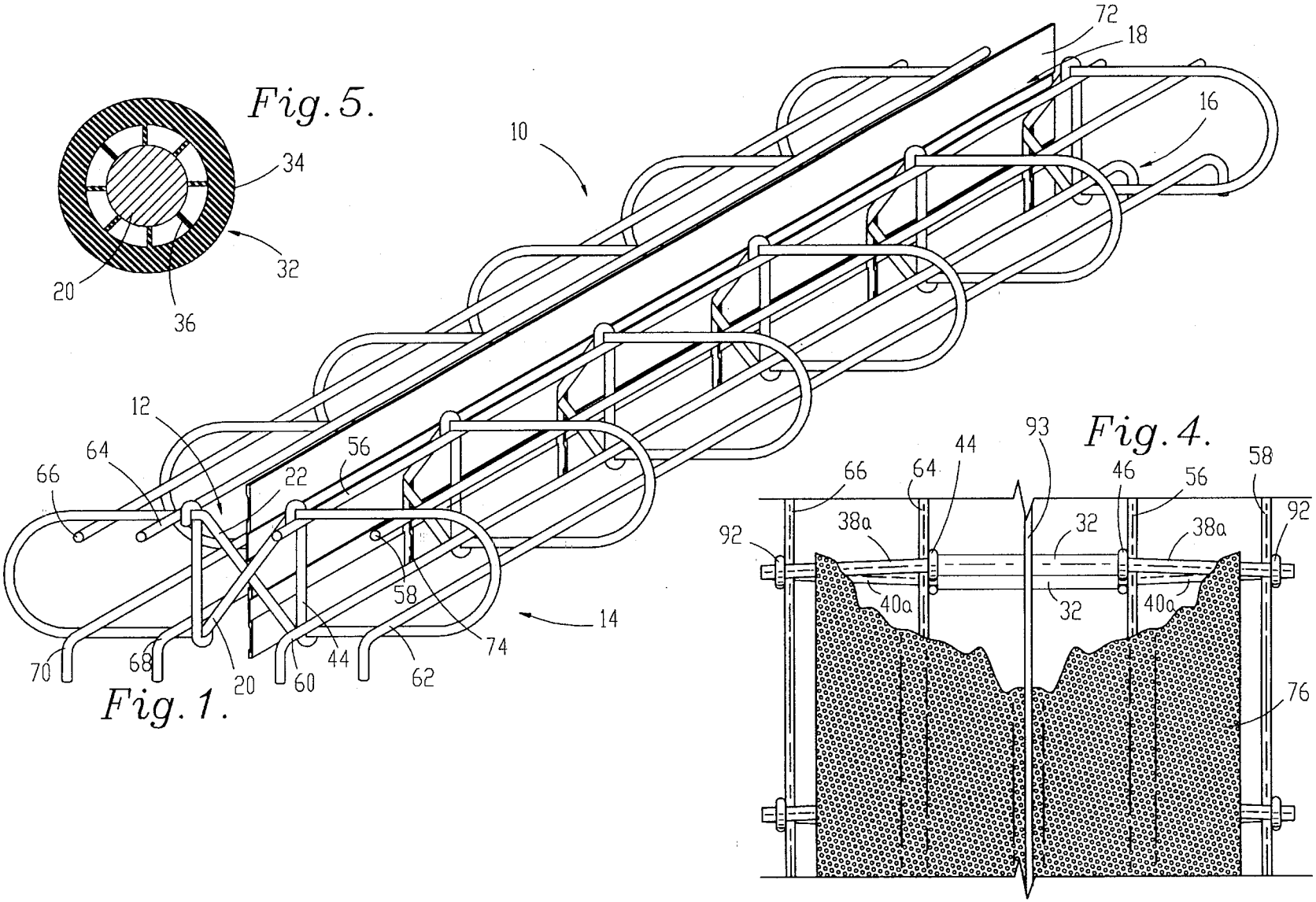
FIG. 1 is an isometric view of the preferred, prefabricated expansion joint assembly of the invention, with the resilient load transfer bar sleeves and the spring-like wire mesh spacer supports being removed to better illustrate the construction of the assembly.
FIG. 4 is a fragmentary plan view illustrating the assembly of FIG. 3.
FIG. 5 is a sectional view taken along line 5—5 of FIG. 2 and depicting the preferred resilient sleeves covering the load transfer bars of the assembly.
Figures 2, 3:
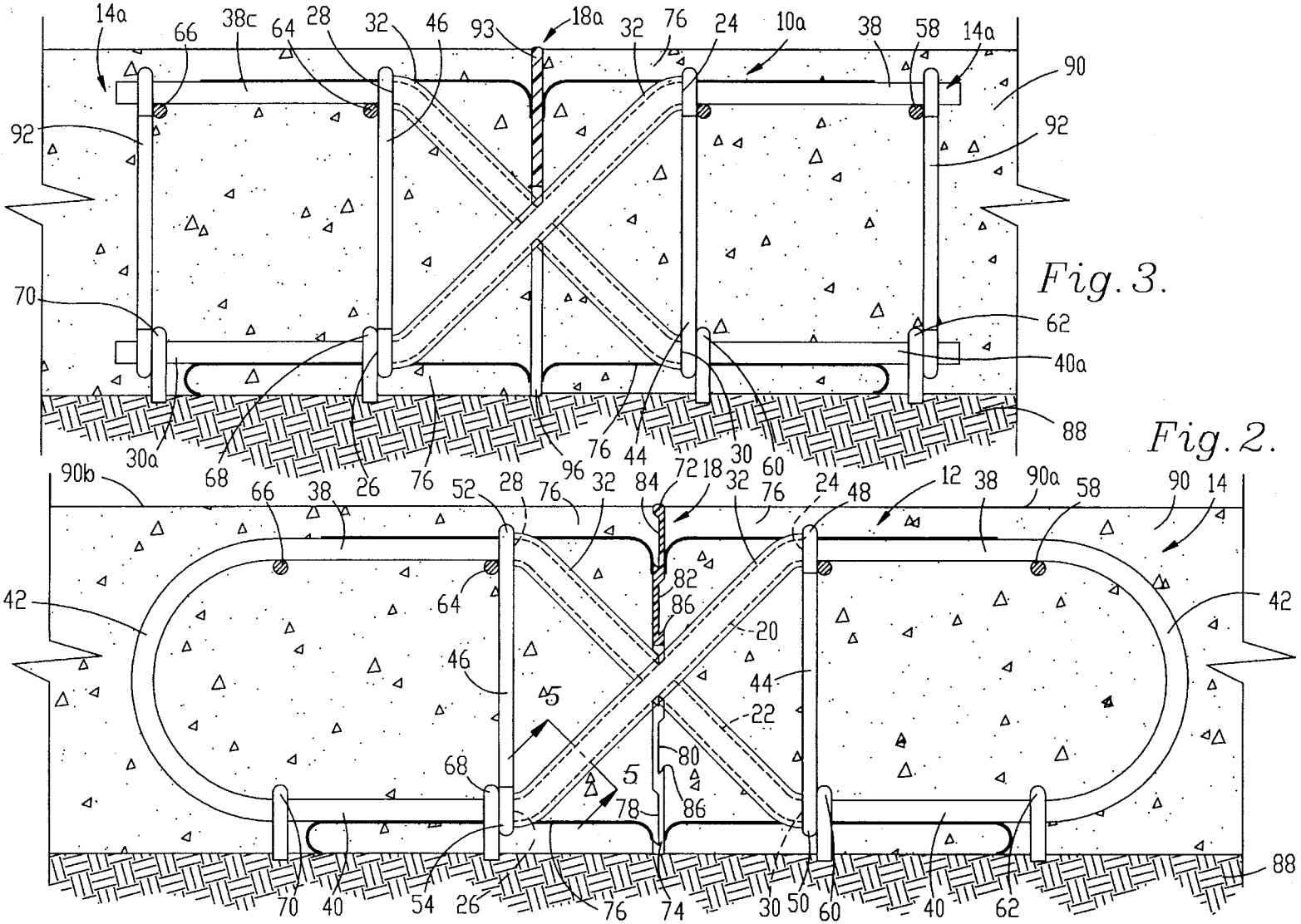
FIG. 2 is a vertical sectional view of the assembly of FIG. 1, operatively embedded in concrete.
FIG. 3 is a vertical sectional view similar to that of FIG. 2, but illustrating an alternate embodiment of the expansion joint assembly.

Turning now to the drawings and particularly FIGS. 1–2, an expansion joint assembly 10 is depicted. Broadly speaking, the assembly 10 includes a plurality of laterally spaced apart load transfer bar units 12, endmost coupling means 14 associated with each of the units 12, lateral connecting rod assembly 16 serving to interconnect and stabilize the bar units 12, and an upright, central, laterally extending spacer member 18 supported by the respective bar units.

In more detail, each bar unit 12 (see FIG. 2) includes a pair of elongated, obliquely oriented load transfer bars 20, 22 which cooperatively present a general X-configuration. The bars 20, 22 each present respective, opposed ends 24, 26 and 28, 30. It will be observed in this respect that end 24 of rod 20 is located directly above end 30 of rod 22, and that end 28 of rod 22 is likewise above end 26 of rod 24. These bars 20, 22 are preferably formed of 60 ksi steel.

Each of the rods 20, 22 are covered with a resilient sleeve 32 along the lengths thereof. As best illustrated in FIG. 5, the preferred sleeve 32 includes a surrounding annular body 34, as well as a plurality of inwardly extending, circumferentially spaced apart ribs 36 in engagement with the metallic rod 20 or 22. Preferably, the annular body 34 has a thickness of about ⅛ inch, whereas the ribs 36 have a thickness of about 1/32 inch and a height of about 1/16 inch. The spacing between the ribs 36 is preferably about ⅓ inch. The spacing between the ribs 36 allows lateral deformation of the sleeve 32 under induced loads. The sleeves 32 may be formed with or without ribs, depending on the nature of the material used; a wide range of materials may be employed, e.g., rubber, polyvinyl, or silicon rubber. The sleeves 32 serve to decouple the bar units from the surrounding concrete, to reduced stresses.

The coupling means 14 is designed to interconnect the vertically spaced ends of the bars forming each bar unit 12. Again referring to FIG. 2, it will be observed that the coupling means 14 is in the form of an arcuate, integral steel member for each end of each X-bar unit 12 and presenting an upper and lower leg section 38, 40, as well as a curved bight 42. The ends of the leg sections 38, 40 remote from bight 42 are respectively connected to the load transfer bar ends, i.e., as illustrated in FIG. 2 leg 38 of the right-hand assembly is connected to end 24, whereas leg 40 is connected to end 30; similarly, leg 38 of the left-hand assembly is connected to end 28, whereas leg 40 is connected to end 26. It will be appreciated in this respect that the U-shaped couplers 14 may be welded to the load transfer bar ends, or can be formed integrally with the load transfer bars. This configuration also serves to reduce contact stresses between the assembly and surrounding concrete, thus minimizing cracking or failure of the concrete.

In addition, in preferred forms, a pair of vertically extending tie rods 44, 46 are installed adjacent the vertically bar ends 24, 30 and 28, 26. The tie rods each present a pair of oppositely directed, U-shaped connection ends 48, 50 and 52, 54. These connection ends are disposed about the junction between the leg sections 38, 40 and the associated load transfer rod ends, and are welded at these points. These vertical tie rods are designed to carry about one-half of the wheel load experienced by the completed roadway.

The connecting rod assembly 16 includes a total of eight elongated, laterally extending rods 56, 58, 60, 62, 64, 66, 68, and 70. As illustrated, the rods 56–62 are connected to the right-hand U-shaped members 14, while the rods 64–70 are connected to the left-hand U-shaped members. In each case, a pair of rods are welded to the upper legs 38 of the respective connectors 14, whereas a corresponding lower pair of rods is welded to the legs 40. The rods 56–70 distribute bearing stresses between the bar units 12 and the surrounding concrete of the finished roadway.

The spacer 18 is in the form of an elongated plate-like member 72 provided with a series of upright slots 74 extending upwardly from the lower margin thereof. The slots 74 are located in spaced relationship to each other, and are oriented for fitting over and receiving the crossed portions of each of the X-configuration load transfer bar units 12. In this fashion, the member 72 may be positioned in an essentially upright orientation and extend laterally the entire width of the assembly 10. As shown in FIG. 2, a series of spring-like wire mesh retainers 76 are welded to the upper legs 38 and are designed to hold the member 72 in its upright orientation during pouring and setting of concrete around the assembly 10.

The preferred spacer 18 includes a plurality of vertically offset, alternating grooves 78, 80, 82 and 84 along the opposed faces thereof, with each of the grooves having along its lower margin an inclined end face 86. The spacer plate may be formed of plastic laminate consisting of an inner web made of synthetic resin or natural fibers treated to prevent decay with the fibers being oriented both vertically and horizontally. The vertical fibers provide paths for conducting moisture to the surface, whereas the horizontal fibers hold the vertical ones in position. Thin synthetic resin sheets may be used to strength the laminate. Moisture removal is caused by a wicking action, with the moisture progressing upwardly for evaporation at the surface.

The assembly 10 is preferably fabricated at a central factory to assume the configuration illustrated in FIG. 1, it being understood that sleeves 32 would be applied to the load transfer bars 20, 22, and that the spring retainers 76 would also be in place; these components have not been illustrated in FIG. 1 for purposes of clarity. In any event, the completed, prefabricated assembly 10 can be trucked to the road site, and placed transversely across a previously prepared road bed 88 (see FIG. 2). It will of course be appreciated that a number of the prefabricated assemblies would be so positioned, at spaced locations corresponding to areas where expansion joints are desired. In any event, after this initial placement, it is only necessary to pour concrete 90 over the expansion joint assemblies and onto the road bed 88 in the usual fashion. Once concrete 90 sets, the roadway is essentially complete, insofar as provision of load transferring expansion joints is concerned. That is, provision of the spacers 18 or **18*a*. Which may be used interchangeably, supported by the expansion joint assemblies defines the necessary joint between adjacent concrete slabs (e.g., the slabs 90*a*, 90*b* shown in FIG. 2**), without the necessity of subsequent sawing.

In use, the vertically oriented tie rods 44, 46 transmit vertical wheel-forces so as to cause tensile and compressive forces to be separately carried in the X-configuration bar units. The bar units thus act as trusses and transmit loads without causing excessive tensile stress in the surrounding concrete.

FIGS. 3–4 illustrate an alternative embodiment in accordance with the invention, making use of an expansion joint assembly **10*a*. The assembly 10*a* is in most respects identical with the assembly 10, except that the endmost couplers 14*a* are somewhat different, and a modified spacer 18*a* is employed. In view of the close similarity of these embodiments, like reference numerals have been applied to all identical parts, and the following discussion will be limited to those areas of the assembly 10*a* which differ in material respects than those of assembly 10**.

Specifically, it will be seen that the couplers **14*a* of the FIG. 3 embodiment are in the form of elongated, horizontally extending legs 38*a*, 40*a*, respectively secured to the load transfer bar ends 24, 30 and 28, 26. Of course, these legs 38*a*, 40*a*, correspond to the legs 38, 40 previously described, and are similarly attached to the load transfer bar ends. However, the ends of the legs 38*a*, 40*a*, remote from the load transfer bars are interconnected by means of vertical tie rods 92 which are similar to the rods 44, 46. The rods 92 are likewise welded to the ends of the legs 38*a*, 40*a*** as shown.

The spacer **18*a* is in the form of an upright member 93 provided with a series of slots 96 identical in configuration to the purpose of the previously described slots 74. However, the member 93** presents essentially flat side surfaces, and includes a plurality of spaced vertical fibers defining therebetween capillary tubes each having a preferred radius of about 0.03 mm.

The use of assembly **10*a* proceeds in exactly the same manner as described with reference to assembly 10. However, the assembly 10*a*** is preferred in that it reduces fabrication costs and tends to form a more stabile configuration.

While in preferred forms, the legs 38, 40 are interconnected by the bights 42 or tie rods 92, the invention is not limited. If these legs are of sufficient length, no mechanical interconnection is required. However, shorter, interconnected legs are preferred because of ease of fabrication.

We claim:

1. An expansion joint assembly comprising:

a pair of separate, adjacent, spaced apart concrete slabs having an elongated expansion joint therebetween;

a pair of elongated load transfer bars each integrally formed and presenting a pair of opposed ends and a leg section extending from each end, one of said leg sections of each bar being embedded in one of said concrete sections in material consisting essentially of concrete, with the other leg section of the bar being embedded in the other of said concrete sections in material consisting essentially of concrete, said bars being oriented obliquely relative to said joint to cooperatively present a general X-configuration of bars bridging said joint, with the opposed leg sections of each bar being embedded in respective slabs, said load transfer bars being unconnected to each other throughout the obliquely oriented lengths thereof so that tensile and compressive loading is separately carried by each of the load transfer bars.

2. The joint assembly of claim 1, including means operably coupling the embedded bar ends within each slab to each other at regions remote from said joint.

3. The joint assembly of claim 2, said coupling means including an arcuate, generally U-shaped rod segment embedded within each slab and presenting a pair of spaced legs and a bight, said legs being operatively connected to said rod ends embedded within the slab.

4. An expansion assembly comprising:

a pair of separate, adjacent spaced apart concrete slabs having an elongated expansion joint therebetween; and a pair of elongated load transfer bars each integrally formed and presenting a pair of opposed ends with elongated, integral segments extending from each of said ends in a direction away from the joint;

said bars being oriented obliquely relative to said joint to cooperatively present a general X-configuration of bars bridging said joint, with the opposed ends of each bar and said integral segment each being embedded in respective concrete slabs in material consisting essentially of concrete, said load transfer bars being unconnected to each other in the region of said joint.

* * * * *